US010694275B2

(12) United States Patent
Chang et al.

(10) Patent No.: US 10,694,275 B2
(45) Date of Patent: Jun. 23, 2020

(54) HEADPHONE

(71) Applicant: HTC Corporation, Taoyuan (TW)

(72) Inventors: Li-Hsun Chang, Taoyuan (TW); Kuan-Ying Ou, Taoyuan (TW)

(73) Assignee: HTC Corporation, Taoyuan (TW)

( * ) Notice: Subject to any disclaimer, the term of this patent is extended or adjusted under 35 U.S.C. 154(b) by 0 days.

(21) Appl. No.: 16/354,189

(22) Filed: Mar. 15, 2019

(65) Prior Publication Data

US 2020/0100012 A1 Mar. 26, 2020

Related U.S. Application Data

(60) Provisional application No. 62/736,407, filed on Sep. 25, 2018.

(51) Int. Cl.
*H04R 1/10* (2006.01)

(52) U.S. Cl.
CPC ..... *H04R 1/1016* (2013.01); *H04R 1/105* (2013.01); *H04R 1/1058* (2013.01)

(58) Field of Classification Search
CPC ..... H04R 1/1016; H04R 1/1058; H04R 1/105
See application file for complete search history.

(56) References Cited

U.S. PATENT DOCUMENTS 3,796,840 A * 3/1974 Ohta ..... H04R 1/1075 381/5
7,853,034 B1 * 12/2010 Gresko ..... H04R 5/033 381/370

FOREIGN PATENT DOCUMENTS

CN 207518786 6/2018
TW M555095 2/2018

OTHER PUBLICATIONS

"Office Action of Taiwan Counterpart Application", dated Mar. 31, 2020, p. 1-p. 4.

* cited by examiner

*Primary Examiner* — Brian Ensey
(74) *Attorney, Agent, or Firm* — JCIPRNET

(57) ABSTRACT

A headphone includes two earphone bodies, a head mount bracket, two elastic portions and two ear cushions. The head mount bracket is connected to the two earphone bodies. The two elastic portions are respectively connected to the two earphone bodies, and respectively have a concave surface. The two ear cushions are respectively disposed on the concave surfaces of the two elastic portions and are used to contact a user's ears.

7 Claims, 3 Drawing Sheets

HEADPHONE

CROSS-REFERENCE TO RELATED APPLICATION

This application claims the priority benefit of U.S. provisional application Ser. No. 62/736,407, filed on Sep. 25, 2018. The entirety of the above-mentioned patent application is hereby incorporated by reference herein and made a part of this specification.

BACKGROUND

Technical Field

The application relates to an ear phone, and in particular to a headphone.

Description of Related Art

Along with a continuous progress of technology, development of various electronic products is growing faster. Among these electronic products, earphones are used to transmit audio information to humans' ears. Apart from aiming to increase sound quality, development of earphones also needs to take care of wearing comfortability. Regarding headphones, in order to allow users to tightly and actually fit headphones to portions around ears on heads, foams are usually used as buffer accessories between earphones and heads.

However, since head shapes of each person are different, part of the users may feel uncomfortable during the process of wearing headphones because of a mismatch between the earphones and contours of head, and a gap is likely to be generated between the earphones and the heads. For example, some people's contours of head presents a larger arc shapes; while some people's contours of head presents a smaller arc shape. FIG. 1 is a section schematic view of a known headphone worn on a user's head. Please refer to FIG. 1. A known headphone 10 includes head mount brackets 11, ear cushions 12 contacting a user's head, connecting portions 13 connected with the ear cushions 12, and earphone bodies 14 connected between the connecting portions 13 and the head mount brackets 11. When the headphone 10 is worn on the user's head, the headphone 10 cannot be completely attached to the head even if ear cushions 12 are installed because the connecting portions 13 adopt a hard material and cannot be deformed. In other words, a gap T is likely to be generated between the contacting surfaces of the ear cushions 12 and the head. Generally, in order to reduce the generation of the gap T, persons engaged in the industry would thicken the ear cushions 12 to eliminate the gap T. This method may reduce the generation of the gap T, but the size of the headphones 10 would be larger and is likely to overly oppress the user's head, making the user feel uncomfortable.

SUMMARY

The application provides a headphone, which increases wearing comfortability of a user and tightness between earphones and the user's head.

The headphone of the application includes two earphone bodies, a head mount bracket, two elastic portions and two ear cushions. The head mount bracket is connected to the two earphone bodies. The two elastic portions are respectively connected to the two earphone bodies, and respectively have a concave surface. The two ear cushions are respective disposed on the concave surfaces of the two elastic portions and are used to contact a user's ear.

Based on the above, the flexible elastic portion of the headphone of the application may properly attach to contours of head of different users, so as to increase the tightness and wearing comfortability.

In order to make the features and advantages of the invention mentioned above more understandable, embodiments will be described in detail below with reference to the accompanying drawings.

DESCRIPTION OF THE EMBODIMENTS

Figure 2:
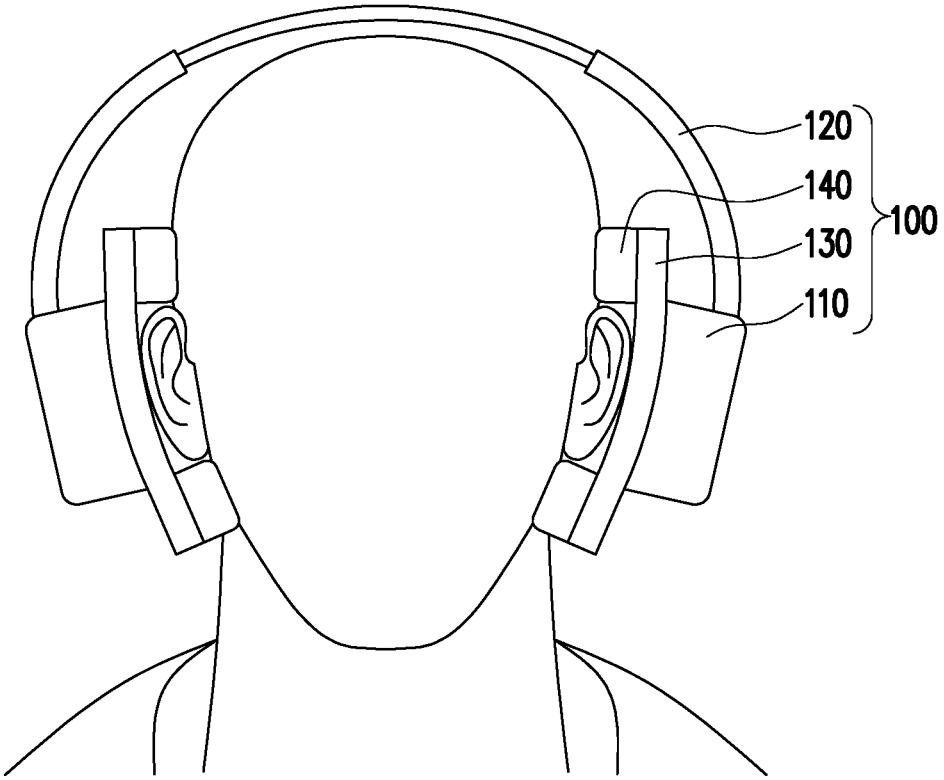
FIG. 2 is a sectional schematic view of a headphone worn on a user's head according to an embodiment of the invention.
Figure 3:
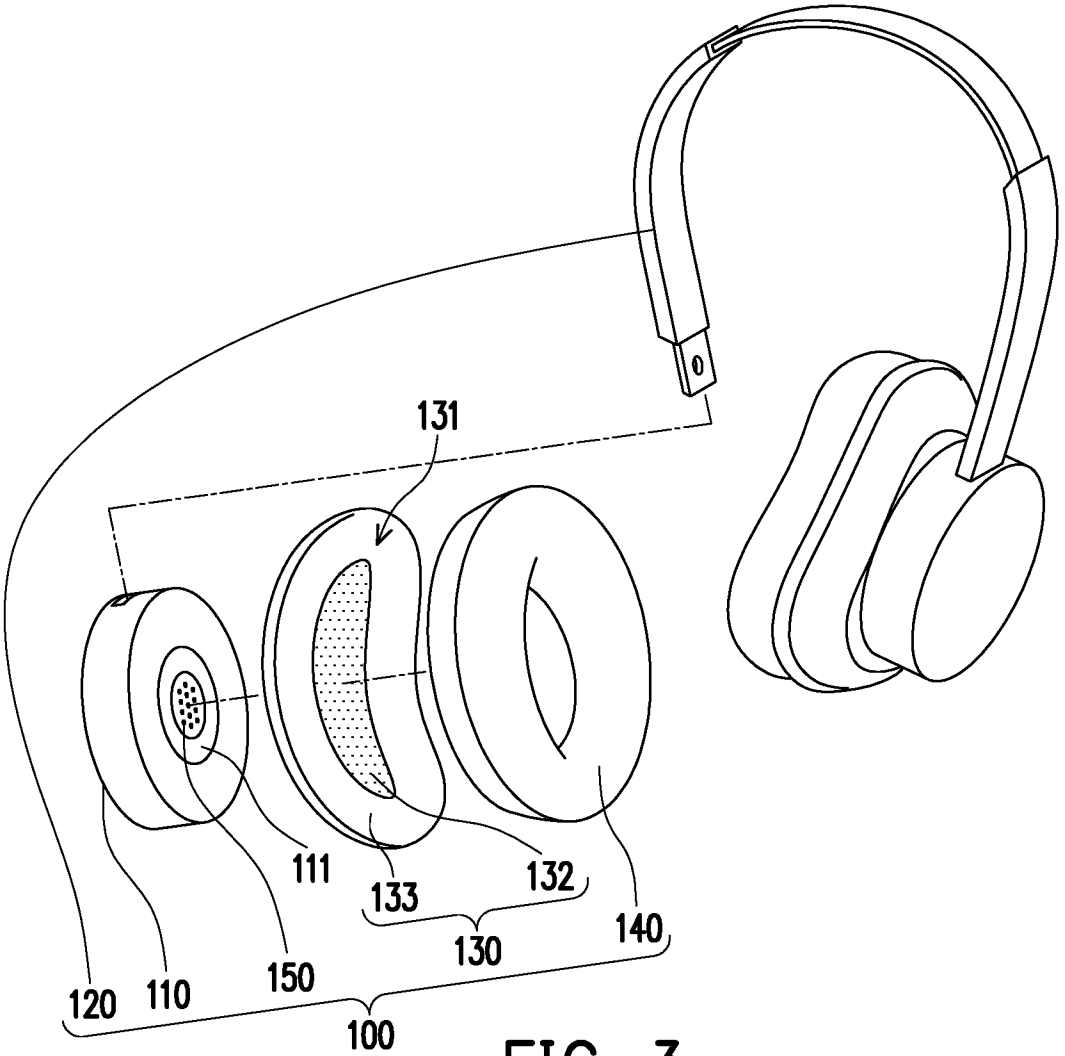
FIG. 3 is an exploded schematic view of the headphone of FIG. 2.

FIG. 2 is a sectional schematic view of a headphone worn on a user's head according to an embodiment of the invention. FIG. 3 is an exploded schematic view of the headphone of FIG. 2. Please refer to FIG. 2 to FIG. 3. A headphone 100 of the present embodiment includes two earphone bodies 110, a head mount bracket 120, two elastic portions 130 and two ear cushions 140. Two ends of the head mount bracket 120 are connected to the two earphone bodies 110, and the two earphone bodies 110 respectively corresponds to a left ear and a right ear of a user. Each elastic portion 130 is connected to an earphone body 110, and has a concave surface 131. Each ear cushion 140 is disposed on the concave surface 131 of one elastic portion 130, and is used to contact the user's ear. For example, a hook and loop fastener, a joint, a buckle or other detachable methods may be adopted to combine between the ear cushions 140 and the elastic portions 130. Therefore, the user may change the ear cushions 140 according to requirements. Besides, methods such as adhesives may also be adopted to fix the ear cushions 140 and the elastic portions 130.

Figure 1:
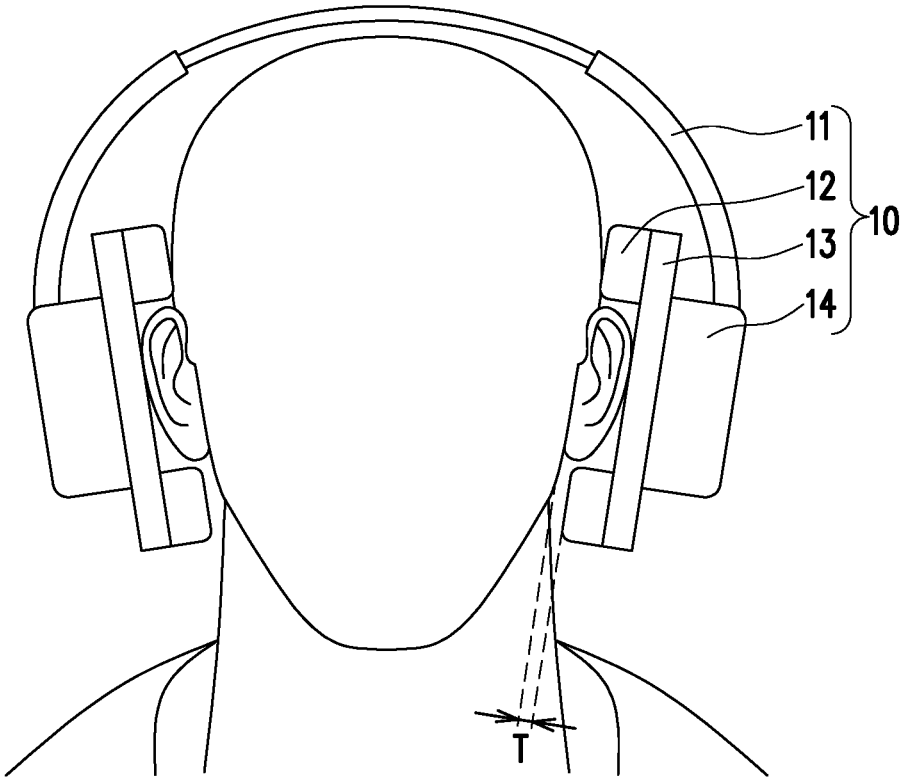
FIG. 1 (PRIOR ART)
FIG. 1 is a sectional schematic view of a known headphone worn on a user's head.

Compared to a hard connecting portion 13 used by a known headphone 10 of FIG. 1, the elastic portions 130 of the present embodiment have elasticity. Therefore, when the headphone 100 is worn on the user's head, the elastic portions 130 may elastically deform according to a head shape of the user, making the ear cushions 140 installed in the elastic portions 130 actually attach to the user's head without generating a gap T between the head and the ear cushions 140, so as to achieve a fine tightness. In addition, the elastic portions 130 have the concave surfaces 131, which may generally fit contours around both ears on the user's head, making the ear cushions 140 positively face contacted users in general to avoid discomfort of the user due to uneven pressure. In other words, the headphone 100 may make the elastic portions 130 bend corresponding to the earphone bodies 110 according to difference of contours of users' heads when being worn, so as to attach to the different contours of the different users' heads, so that the tightness and the wearing comfortability are increased. Besides, the ear cushions 140 may fully cover ears to increase the tightness and the sound quality when listening.

Length of the head mount bracket 120 of the present embodiment may be adjusted to correspond to different sizes of the users' heads. For example, the head mount bracket 120 may be extended or shortened through an adjusting component (not drawn in FIGS), but the application does not limit the method of adjusting the length of the head mount bracket 120 herein.

Please refer to FIG. 3, in the present embodiment, each earphone body 110 has a chamber 111, and the headphone 100 further includes two speakers 150. Each speaker 150 is disposed in the corresponding chamber 111, and the speakers 150 are used to generate sound wave.

In the present embodiment, each earphone body 110 and the corresponding elastic portion 130 may be integrally formed, and may also be manufactured separately, and is not limited herein. Besides, materials of the earphone body 110 and the corresponding elastic portion 130 may be the same or different no matter they are integrally formed or not.

In the present embodiment, the two ear cushions 140 may be tightly and closely attached to the user's head and increase the wearing comfortability. For example, the material of the ear cushions 140 includes a foam, and the foam may be covered by leather outer layer or cloth outer layer, or a flocking foam may be adopted; the application does the limit the material herein.

In the present embodiment, each elastic portion 130 includes a central zone 132 and a marginal zone 133 surrounding the central 132. The earphone body 110 is located in the corresponding central zone 132 of the elastic portion 130. In the present embodiment, a material of the central zone 132 is an air permeable material, so that the sound provided by the earphone body 110 may transmit to the user's ear through the central zone 132. The area of the central zone 132 may be larger than, equals to or smaller than the area of the earphone body 110. A material of the marginal zone 133 may be plastic, rubber or other elastic deformable materials.

Based on the above, in the headphone of the application, the concave surface of the elastic portion may fit the contours around the ears of a major part of the user's head, and the elastic portion may elastically deform corresponding to the contour of the user's head, so as to increase the tightness and the wearing comfortability.

Although the invention has been disclosed in the above embodiments, the embodiments are not intended to limit the invention, and those skilled in the art may make some modifications and refinements without departing from the spirit and scope of the invention. Therefore, the scope of the invention is defined by the claims attached below.

What is claimed is:

1. A headphone comprising:

two earphone bodies;

a head mount bracket connected to the earphone bodies;

two elastic portions respectively connected to the earphone bodies and respectively have a concave surface; and two ear cushions respectively disposed on the concave surfaces of the elastic portions and are used to contact a user's ears, wherein the elastic portions are adapted to deform elastically to fit to a contour of the user's head.

2. The headphone according to claim 1, wherein each of the elastic portions comprises a central zone and a marginal zone surrounding the central zone, and each of the earphone bodies is located in the corresponding central zone.

3. The headphone according to claim 2, wherein a material of the central zones is an air permeable material.

4. The headphone according to claim 2, wherein a material of the marginal zones is plastic or rubber.

5. The headphone according to claim 1, wherein each of the earphone bodies and the corresponding elastic portion are integrally formed.

6. The headphone according to claim 1, wherein a length of the head mount bracket is adjustable.

7. The headphone according to claim 1, wherein a material of each of the ear cushions comprises a foam.

* * * * *